US005395699A

United States Patent [19]

Ernst et al.

[11] Patent Number: 5,395,699

[45] Date of Patent: Mar. 7, 1995

[54] COMPONENT, IN PARTICULAR TURBINE BLADE WHICH CAN BE EXPOSED TO HIGH TEMPERATURES, AND METHOD OF PRODUCING SAID COMPONENT

[75] Inventors: Peter Ernst, Niederglatt; Manfred Thumann, Ennetbaden; Christoph Tönnes, Birmenstorf, all of Switzerland

[73] Assignee: Asea Brown Boveri Ltd., Baden, Switzerland

[21] Appl. No.: 70,942

[22] Filed: Jun. 4, 1993

[30] Foreign Application Priority Data

Jun. 13, 1992 [DE] Germany ..... 42 19 469.5

[51] Int. Cl.[6] ..... B32B 15/02

[52] U.S. Cl. ..... 428/547; 428/548; 428/567; 428/569

[58] Field of Search ..... 428/547, 548, 553, 567, 428/569; 419/6, 8, 48, 49, 51

[56] References Cited

U.S. PATENT DOCUMENTS

| | | | |
|---|---|---|---|
| 2,946,680 | 7/1960 | Raymont | 75/200 |
| 3,940,268 | 2/1976 | Catlin | 75/208 R |
| 3,992,200 | 11/1976 | Chandhok | 75/211 |
| 4,063,939 | 12/1977 | Weaver et al. | 75/208 R |
| 4,097,276 | 6/1978 | Six | 75/208 R |
| 4,294,615 | 10/1981 | Blackburn et al. | 75/175.5 |
| 4,323,394 | 4/1982 | Hoffmuller et al. | 75/208 R |
| 4,329,175 | 5/1982 | Turner et al. | 75/208 R |
| 4,383,809 | 5/1983 | Hoffmuller | 425/78 |
| 4,445,259 | 5/1984 | Ekbom | 29/156.8 B |
| 4,492,737 | 1/1985 | Conolly | 428/552 |
| 4,526,747 | 7/1985 | Schimmel et al. | 419/8 |
| 4,663,241 | 5/1987 | Doherty et al. | 428/547 |
| 4,680,160 | 7/1987 | Helmink | 419/6 |
| 4,828,793 | 5/1989 | Froes et al. | 419/6 |
| 4,897,127 | 1/1990 | Huang | 148/133 |
| 4,900,635 | 2/1990 | Bowen et al. | 428/547 |
| 5,190,603 | 3/1993 | Nazmy et al. | 148/671 |
| 5,226,985 | 7/1993 | Kim et al. | 148/671 |

FOREIGN PATENT DOCUMENTS

| | | |
|---|---|---|
| 0061322A | 9/1982 | European Pat. Off. . |
| 2136170 | 12/1972 | France . |
| 2239214 | 2/1973 | Germany . |
| 2122353 | 7/1977 | Germany . |
| 2813892 | 10/1978 | Germany . |
| 2737248 | 3/1979 | Germany . |
| 3103129A | 3/1982 | Germany . |
| 3543831C | 6/1989 | Germany . |
| 4010076A | 10/1990 | Germany . |
| 4022403A | 1/1991 | Germany . |
| 3511673C | 2/1991 | Germany . |
| 4037959A | 6/1991 | Germany . |
| 4121215A | 1/1992 | Germany . |
| 4121228A | 1/1992 | Germany . |
| 608766 | 9/1948 | United Kingdom . |
| 1330555 | 9/1973 | United Kingdom . |

OTHER PUBLICATIONS

"Turbinenschaufel mit hoher Warm-und Zunderfestigkeit, insbesondere fur Gasturbinen, sowie Verfahren zu ihrer Herstellung", R. Keiffer, Jan. 1952, pp. 1-7.

*Primary Examiner*—Donald P. Walsh
*Assistant Examiner*—Chrisman D. Carroll
*Attorney, Agent, or Firm*—Burns, Doane, Swecker & Mathis

[57] ABSTRACT

A turbine blade including a blade foot and a blade. The blade foot is formed by a ductile material and the blade comprises a material which is brittle compared to the ductile material but resistant to high temperature. The two materials are alloys of different chemical compositions and are hot-compacted with the formation of a boundary layer joining the blade foot and blade to produce a bimetallic composite material. The blade foot predominantly comprises a titanium-base alloy and the blade comprises a gamma-titanium aluminide containing 0.5 to 8 atomic percent of a dopant. The turbine blade exhibits outstanding mechanical properties at high temperatures, good ductility at room temperature and a long service life.

12 Claims, 2 Drawing Sheets

COMPONENT, IN PARTICULAR TURBINE BLADE WHICH CAN BE EXPOSED TO HIGH TEMPERATURES, AND METHOD OF PRODUCING SAID COMPONENT

BACKGROUND OF THE INVENTION

1. Field of the Invention

The invention relates to a component useful at high temperatures, in particular a turbine blade having a blade foot and a blade.

2. Discussion of Background

A turbine blade component and a method of producing such a component are disclosed in DE 28 13 892 A1. The component is constructed as a turbine wheel which has been produced by hot pressing of metal powders having different particle structures and different chemical compositions. In the case of this turbine wheel, the starting material used for the buckets was mechanically pretreated powder of a nickel-base superalloy such as, for example, the alloy IN 792, having particles in the form of flattened spheroids. The starting material used for the wheel disk was a mechanically unpretreated powder of another nickel-base superalloy such as, for example, the alloy IN 100, having spherical particles. Because of the structure and the chemical composition of the starting powders, the buckets are distinguished by a good corrosion resistance at high temperatures and the wheel disk has a high tensile strength and a good fatigue resistance. However, only those alloys are suitable as starting materials for the turbine wheel which, like the nickel-base superalloys which are very closely related to one another, can be exposed to the high temperatures during hot isostatic pressing without alteration of their microstructure and consequently of their properties. In the production of this turbine wheel, no alloys can be used which although they each inherently have outstanding properties for various purposes they can be hot-compacted only at temperatures which are appreciably different from one another.

SUMMARY OF THE INVENTION

Accordingly, one object of the invention, is to provide a component, in particular a turbine bucket, of the type mentioned in the introduction which is distinguished by a long service life when used in an appliance, such as in particular a gas turbine, operated at high temperatures, and at the same time to indicate a method which makes it possible to produce such a component simply and in a manner which is suitable for mass production.

Compared with comparable components in accordance with the prior art, the component in accordance with the invention is distinguished by a long service life. This is due to the fact, on the one hand, that differently stressed parts of the component are composed of differently specified alloys which are matched to the different stressings of the parts of the component. On the other hand, these alloys are selected in such a way that they form a high-strength boundary layer When hot-compacted to form a bimetallic composite material. The component in accordance with the invention can therefore absorb with high reliability high thermal and mechanical loadings such as those which occur, for instance, during the operation of a gas turbine or of a compressor in a turbocharger.

The method used to produce the components according to the invention is one in which the hot compacting is performed at temperatures at which the microstructures of the alloys required for the desired physical or chemical properties are present with high reliability even if the alloys forming the starting powders have chemical compositions differing markedly from one another.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
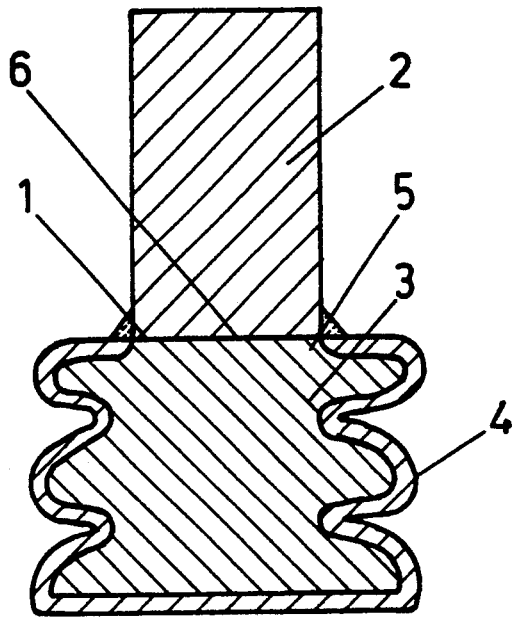
FIG. 1 shows a view of a section taken in the longitudinal direction through a first variant of a component according to the invention and constructed as a turbine bucket after completion of a hot isostatic pressing operation carried out during the production method.
Figure 2:
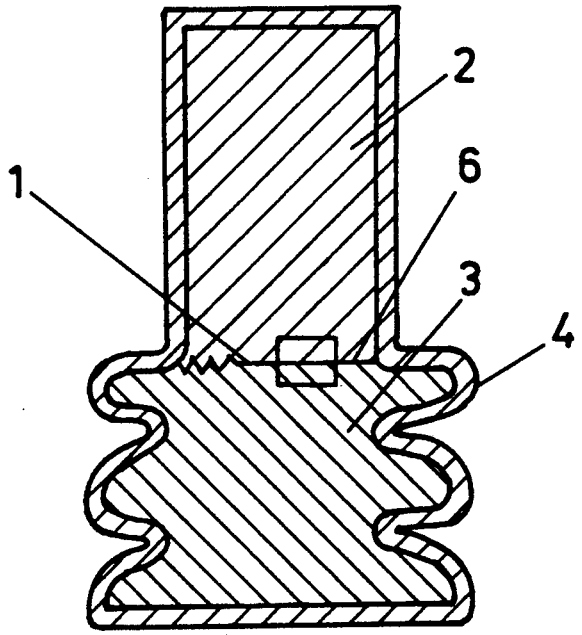
FIG. 2 shows a view of a section taken in the longitudinal direction through a second variant of a component according to the invention and constructed as a turbine bucket after completion of a hot isostatic pressing operation carried out during the production.

Referring now to the drawings, wherein like reference numerals designate identical or corresponding parts throughout the several views, the components shown in FIGS. 1 and 2 and each constructed as turbine bucket 1 comprise, in each case, an elongated bucket blade 2 and a bucket footing 3 formed at the end of the bucket blade 2. Reference symbol 4 denotes a pressing can. In the embodiment according to FIG. 1, said pressing can encloses the bucket footing 3 and has an opening 5 which is filled by the bucket blade 2 and which is gastightly sealed preferably by welding or soldering the pressing can 4 onto the bucket blade 2. In the embodiment according to FIG. 2, the pressing can 4 encloses the entire turbine bucket 1.

The turbine bucket 1 shown in FIG. 1 is produced as follows: The end of a casting constructed as bucket blade 2 is introduced into the pressing can 4 through the opening 5. The pressing can 4, which is preferably composed of steel, is welded or soldered onto the casting in the region of the opening 5 in a gastight manner. A cavity in the pressing can 4 which receives the bucket footing of the turbine bucket 1 is filled with an alloy powder through a further opening in the pressing can 4 which is not shown. The pressing can 4 is then evacuated and gastightly sealed.

The material used for the casting is a doped gamma-titanium aluminide and that used for the powder is an alloy based on titanium or nickel. The alloy forming the casting is advantageously a gamma-titanium aluminide containing a proportion of at least 0.5 to not more than 8 atomic percent of dopant, such as, for example, one or more of the elements B, C, Co, Cr, Ge, Hf, Mn, Mo, Nb, Pd, Si, Ta, V, Y, W and Zr. A typical alloy is, for example, one which contains 48 atomic percent of Al, 2 to 4 atomic percent of chromium, and Ti as the remainder in addition to unavoidable impurities. An alloy which has proved particularly satisfactory has the composition specified as follows in weight percent: 33.2 Al, 3.9 Cr, impurities less than 0.5, the remainder being Ti. Gamma-titanium aluminides are distinguished by a low density and a good mechanical resistance at temperatures of up to 800° C. However, their ductility is comparatively low (<4%).

The titanium-based alloy used in the form of powder comprises, in addition to titanium, aluminum and a proportion of up to 20 atomic percent of one or more additive elements such as, in particular, V and/or Nb. Typical alloys comprise, in addition to unavoidable impurities and Ti, either 6 atomic percent of Al and 4 atomic percent of V or 24 atomic percent of Al and 11 atomic percent of Nb.

The nickel-base alloy used in the form of powder may, for example, be the alloy IN 792 (composition in percent by weight of Ni, 0.12 C, 12.4 Cr, 9.0 Co, 1.9 Mo, 3.8 W, 3.9 Ta, 3.1 Al, 4.5 Ti, 0.2 B, 0.1 Zr).

With all the powders used, the size of the powder particles is less than 500 μm. Such titanium- and nickel-base alloys are distinguished by a good ductility (>10%) at room temperature. The mechanical resistance of the titanium-based alloys at high temperatures is, however, not as high as that of gamma-titanium aluminides. Nickel-base alloys, on the other hand, have a density which is substantially higher than the gamma-titanium aluminides.

The specimen produced by gastight sealing of the pressing can 4 was introduced into a pressing appliance and hot-isostatically compacted at temperatures between 900° and 980° C. using a titanium-base alloy. A typical pressing operation lasted approximately 3 hours at approximately 950° C. under a pressure of approximately 200 MPa. In this case, the two alloys were compacted in a pore-free manner to form a bimetallic composite material with the formation of a boundary layer 6.

This composite material, which already had the form of a turbine bucket, was then heat-treated at temperatures of approximately 700° C. for typically 4 hours after removing the deformed pressing can 4. Subsequently, the turbine bucket in accordance with the invention was produced by slight material-removing working such as grinding, polishing and/or electrochemical treatment.

In the production of the turbine bucket 1 seen in FIG. 2, a pressing can 4 was used which was enlarged in the longitudinal direction and accommodated the entire turbine bucket 1. The casting forming the bucket blade 2 was first introduced into said pressing can 4 and the alloy powder was then poured in in accordance with the exemplary embodiment described above. The pressing can 4 was then evacuated and sealed in a gastight manner. The specimen produced in this way was treated in accordance with the exemplary embodiment described above. The alloys used had the same composition as in the exemplary embodiment described above.

Figure 3:
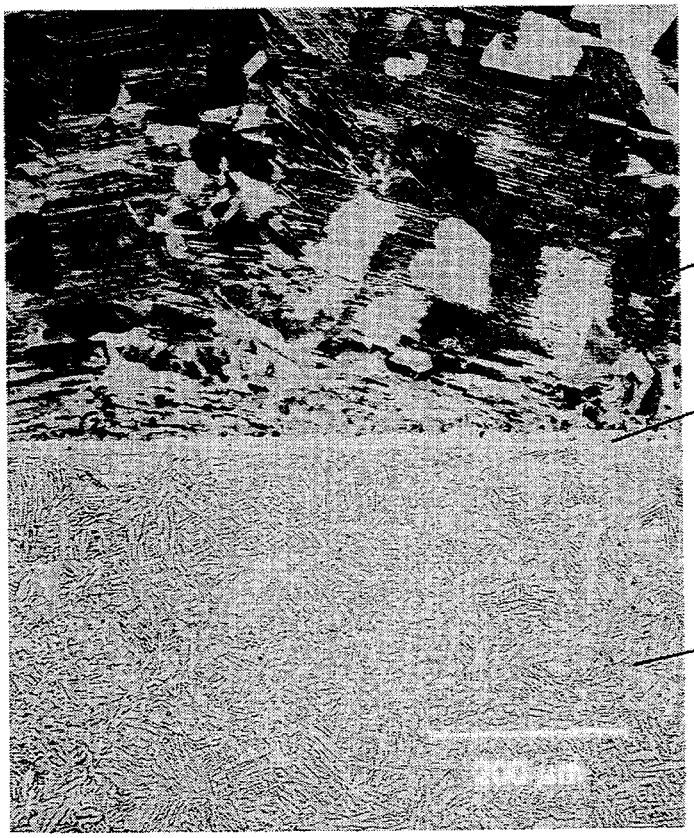
FIG. 3 shows a micrograph of that region of the second variant of the component according to the invention which corresponds to a location indicated by a box in FIG. 2.

The structure and microstructure of a part, indicated by a box in FIG. 2, of the turbine bucket according to the invention is revealed by the micrograph shown in FIG. 3. From this it can be seen that the alloy forming the bucket blade 2 has a coarse-grained microstructure and the alloy forming the bucket footing 3 has a fine-grained one, and that the boundary layer 6 joining the two alloys together is virtually unstructured and, according to chemical analysis, is essentially formed by a binary TiAl alloy containing a proportion of approximately 25 atomic percent of Al.

Material investigations have revealed the following properties for the bimetallic composite material forming the basis of the turbine bucket 1 according to the invention:

At room temperature, the alloy forming the bucket blade 2 has a ductility of approximately 0.5 to 1%, whereas the alloy forming the bucket footing 3 has one of 18 to 20% At a temperature of approximately 700° C. the bucket blade 2 has a creep strength which is appreciably above the creep strength of the nickel-base superalloys customarily used in this temperature range. The turbine bucket 1 has a ductility equal to that of the material of the bucket blade 2 of 0.5 to 1%, and this means that the ductility of the bucket is not adversely affected by the boundary layer 6. Accordingly, the turbine bucket 1 according to the invention is distinguished by a bucket footing 3 having high ductility and a bucket blade 2 which, although brittle at room temperature, has a high creep strength at high temperatures. The strength of the boundary layer 6 is sufficient to ensure reliable operation of the turbine bucket 1 at high tempertures.

An increased strength of the boundary layer 6 can be achieved by keying the two alloys (as shown in FIG. 2) at least partially or even completely with one another in the region of the boundary layer 6. This can be effected in a simple manner before introducing the casting into the pressing can 4 by grinding or sand blasting the casting at its end which accommodates the bucket footing 3 to produce a peak-to-valley height of up to 0.1 mm.

Instead of a casting which forms the bucket blade 2, a body composed of a hot-isostatically compacted powder can also be introduced into the pressing can 4. In a further alternative embodiment of the invention, approximately 100 g of an alloy powder containing 48 atomic percent of Al, 3 atomic percent of Cr, the remainder being Ti and small amounts of impurities were hot-isostatically compacted at temperatures of between 1050° and 1300° C. and a pressure of approximately 250 MPa for approximately 3 hours. The compacted powder was then heat-treated at temperatures of between 1300° and 1400° C. for a few hours. The resulting body was then introduced into the pressing can 4 shown in FIG. 2 and hot-isostatically compacted together with the powder forming the bucket footing 3 under the conditions described there. Compared with the turbine bucket shown in FIG. 2, the turbine bucket resulting after suitable heat treatment and suitable finishing had a ductility of the bucket blade 2 at room temperature which was increased by approximately 50% while the creep strength remained constant.

In a further variant of the invention, a bucket footing 3 composed of a nickel-base alloy was formed onto the bucket blade composed of gamma-titanium aluminide. For this purpose, powder of the nickel-base alloy was poured into the pressing can 4 which already contains the bucket blade or, alternatively, which is welded onto the bucket blade. The pressing can 4 was evacuated and sealed in a gastight manner. Hot isostatic pressing for approximately 3 hours at approximately 1000° to 1250° C. and a pressure of approximately 250 MPa produced a pore-free bimetallic composite material from which a turbine bucket according to the invention was produced after removing the pressing can 4, after heat treatment at approximately 700° to 800° C. and after material-removing finishing. In the case of this turbine bucket, the boundary layer 6 had a particularly good strength.

In a further variant of the invention, it is possible to use a sintering mould as the mould for accommodating the alloys instead of a pressing can 4 and to achieve the compacting to form the turbine bucket in a sintering process.

The invention is not limited to turbine buckets. It also relates to other components which are heavily loaded mechanically at high temperatures, such as, for instance, integrally constructed turbine wheels of turbochargers.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A turbine blade, which can be exposed to high temperatures, comprising a blade root formed from a first material which is ductile and a blade formed from a second material which is brittle compared with the first material, the first and second materials comprising first and second alloys of different chemical compositions which have been hot-compacted with the formation of a boundary layer joining the blade root and the blade to produce a bimetallic material, the first alloy forming the blade root being a titanium-based alloy and the second alloy forming the blade being a gamma titanium aluminide containing a proportion of at least 0.5 and at most 8 atomic percent of dopant, and the boundary layer being essentially formed by a binary titanium aluminum alloy ensuring reliable operation of the turbine blade at high temperature.

2. The turbine blade of claim 1, wherein the binary titanium aluminum alloy contains approximately 25 atomic percent of aluminum.

3. The turbine blade of claim 1, wherein the dopant comprises one or more elements selected from the group consisting of B, C, Co, Cr, Ge, Hf, Mn, Mo, Nb, Pd, Si, Ta, V, Y, W and Zr.

4. The turbine blade of claim 2, wherein the dopant comprises one or more elements selected from the group consisting of B, C, Co, Cr, Ge, Hf, Mn, Mo, Nb, Pd, Si, Ta, V, Y, W and Zr.

5. The turbine blade of claim 3, wherein the first alloy includes vanadium or niobium.

6. The turbine blade of claim 4, wherein the first alloy includes vanadium or niobium.

7. The turbine blade of claim 1, wherein the blade root and the blade are keyed into one another in the region of the boundary layer.

8. The turbine blade of claim 1, wherein the first alloy includes up to 20 atomic percent of V, Nb or V and Nb.

9. The turbine blade of claim 1, wherein the first alloy includes 6 atomic percent Al and 4 atomic percent V.

10. The turbine blade of claim 1, wherein the first alloy includes 24 atomic percent Al and 11 atomic percent Nb.

11. The turbine blade of claim 1, wherein the second alloy comprises a sintered powder having a particle size of less than 500 nm.

12. The turbine blade of claim 1, wherein the blade has a grain structure which is more coarse than a grain structure of the blade root.

* * * * *